US010989462B2

(12) United States Patent
Zhang et al.

(10) Patent No.: US 10,989,462 B2
(45) Date of Patent: Apr. 27, 2021

(54) REFRIGERATOR DOOR BODY AND REFRIGERATOR HAVING THE SAME

(71) Applicant: QINGDAO HAIER JOINT STOCK CO., LTD., Qingdao (CN)

(72) Inventors: Yanqing Zhang, Qingdao (CN); Rui Ge, Qingdao (CN); Weishou Sun, Qingdao (CN)

(73) Assignee: QINGDAO HAIER JOINT STOCK CO., LTD., Qingdao (CN)

( * ) Notice: Subject to any disclaimer, the term of this patent is extended or adjusted under 35 U.S.C. 154(b) by 118 days.

(21) Appl. No.: 16/470,200

(22) PCT Filed: Dec. 14, 2017

(86) PCT No.: PCT/CN2017/116030

§ 371 (c)(1),
(2) Date: Jun. 14, 2019

(87) PCT Pub. No.: WO2018/108116

PCT Pub. Date: Jun. 21, 2018

(65) Prior Publication Data

US 2019/0331404 A1 Oct. 31, 2019

(30) Foreign Application Priority Data

Dec. 14, 2016 (CN) ..... 201611153006.8

(51) Int. Cl.

| | |
|---|---|
| ***F25D 23/12*** | (2006.01) |
| ***B67D 1/00*** | (2006.01) |
| ***F25D 23/02*** | (2006.01) |

(52) U.S. Cl.
CPC ..... *F25D 23/126* (2013.01); *B67D 1/0009* (2013.01); *B67D 1/0082* (2013.01); *F25D 23/028* (2013.01); *B67D 2001/0094* (2013.01)

(58) Field of Classification Search
CPC ..... F25D 23/126; F25D 23/028; B67D 1/009; B67D 1/0082; B67D 2001/0094
See application file for complete search history.

(56) References Cited

U.S. PATENT DOCUMENTS

| | | | | |
|---|---|---|---|---|
| 9,738,504 | B2 * | 8/2017 | Aranda | F25C 5/22 |
| 2017/0248362 | A1 * | 8/2017 | Choo | B67D 1/0081 |

FOREIGN PATENT DOCUMENTS

| | | | |
|---|---|---|---|
| CN | 102818423 | A | 12/2012 |
| CN | 103673478 | A | 3/2014 |

(Continued)

*Primary Examiner* — David J Teitelbaum
(74) *Attorney, Agent, or Firm* — Cheng-Ju Chiang

(57) ABSTRACT

The present invention provides a refrigerator door body with a water dispenser and a water intake passage arranged thereon. A water intake assembly of the water dispenser comprising: a water inlet component, a water outlet component, a valve core and a water intake handle. The water intake handle has one end pivotally connected to the refrigerator door body and is provided with a through hole. When the water intake assembly is in a closed status, there is no acting force between the water outlet component and the through hole in the water intake handle; and the other end of the water intake handle is pressed such that one end, pivotally connected to the refrigerator door body, of the water intake handle is rotated. The water outlet component is displaced axially relative to the water inlet component and thus the water intake assembly is in an open status.

9 Claims, 5 Drawing Sheets

(56) References Cited

FOREIGN PATENT DOCUMENTS

| | | | |
|---|---|---|---|
| CN | 203717945 | U | 7/2014 |
| CN | 203771876 | U | 8/2014 |
| CN | 203771877 | U | 8/2014 |
| CN | 105371576 | A | 3/2016 |
| CN | 105919425 | A | 9/2016 |
| CN | 106595202 | A | 4/2017 |
| KR | 10-2007-0069774 | A | 7/2007 |
| WO | 2015/144244 | A1 | 10/2015 |

* cited by examiner

REFRIGERATOR DOOR BODY AND REFRIGERATOR HAVING THE SAME

CROSS-REFERENCE TO RELATED APPLICATION

The present application is a 35 U.S.C. § 371 National Phase conversion of International (PCT) Patent Application No. PCT/CN2017/116030, filed on Dec. 14, 2017, which claims the priority of Chinese patent application No. 201611153006.8 filed on Dec. 14, 2016 and titled "Refrigerator Door Body and Refrigerator Having the Same", which is incorporated herein by reference in its entirety. The PCT International Patent Application was filed and published in Chinese.

TECHNICAL FIELD

The present invention relates to the technical field of household appliances, and particularly, to a refrigerator door body and a refrigerator having the same.

BACKGROUND

With the constant development of science and technology, refrigerators have an increasing number of additional functions. At present, there is a refrigerator with a function of providing drinking water. The refrigerator door body is provided a water dispenser. In this way, users can directly drink cold water provided by the refrigeration function of the refrigerator, thereby satisfying the user's demand of directly drinking cold water.

In the prior art, a water intake structure on a refrigerator door body generally includes a water inlet component, a valve core, a water outlet component, a sealing gasket and a pressure tongue. The water inlet component and the water outlet component are embedded with each other and a spring is arranged therebetween. The water outlet component is fixed to one end of the valve core, and the water outlet component is controlled by the pressure tongue to drive the valve core and the sealing gasket to reciprocate along the axial direction of a water outlet nozzle in order to realize the water intake function.

However, in the prior art, the pressure tongue structure of the water intake structure is complex, and the water intake structure is difficult to assemble and low in reliability. Consequently, user experience is reduced.

SUMMARY

It is an object of the present invention to provide a refrigerator door body that can solve the above technical problems.

In order to achieve the above object, the present invention provides a refrigerator door body.

It is still another object of the present invention to provide a refrigerator.

The refrigerator door body is provided with a water dispenser and a water intake passage. The water dispenser comprising: a water storage tank disposed at an inner side of the refrigerator door body and a water intake assembly at least partially disposed in the water intake passage. The water intake assembly comprises:

a water inlet component comprising a water inlet component housing and a first sealing wall protruding from an inner wall of the water inlet component housing, wherein a water inlet is formed in one end of the housing; a stopper is arranged on the inner wall of one end of the first sealing wall away from the water inlet in a protruding manner; and the water inlet is communicated with the water storage tank;

a water outlet component comprising a water outlet component housing and a second sealing wall protruding from one end of the water outlet component housing, wherein the second sealing wall and the water inlet component housing are embedded with each other, and a water outlet nozzle is arranged at the other end of the water outlet component housing;

a valve core disposed in the water inlet component in an inserting manner, wherein a sealing member sleeves the valve core, and one end of the valve core adjacent to the sealing member and the water outlet component are fixed to each other; and a water intake handle having one end pivotally connected to the refrigerator door body and being provided with a first through hole for allowing the water outlet component to pass through.

When the water intake assembly is in a closed status, the sealing member abuts against the stopper, and there is no acting force between the water outlet component housing and the first through hole in the water intake handle.

The other end of the water intake handle is pressed, such that one end, pivotally connected to the refrigerator door body, of the water intake handle is rotated. The first through hole applies an acting force to the water outlet component housing. The water outlet component is displaced axially relative to the water inlet component, such that a gap is generated between the sealing member and the stopper, and the water intake assembly is in an open status.

As an improvement, a sleeve is provided in an inner wall of the water intake passage. A sealing ring is provided between the sleeve and the water inlet component housing. The sleeve is provided with a step portion at the end close to the water storage tank. The upper end of the sealing ring is fixed to the step portion by a pressing cap.

As a further improvement, the pressing cap includes a second through hole and an upper edge and a lower edge which extend outwards along the upper and lower ends of the second through hole respectively. The width of the upper edge is greater than the width of the lower edge.

As a further improvement, a sealing protrusion connected to the lower edge is arranged on the inner wall of the second through hole in a protruding manner.

As a further improvement, the step portion is provided with a positioning block. The lower edge is provided with a positioning notch being adapted to the positioning block. The positioning notch corresponds to the positioning block, so that the pressing cap is mounted on the step portion of the sleeve.

As a further improvement, the sealing protrusion covers a gap between the sleeve and the water inlet component housing.

As a further improvement, the outer side of the refrigerator door body is recessed to form a receiving space. The water outlet component is at least partially exposed in the receiving space. A housing is arranged on the wall of the receiving space, and a bracket is arranged at the upper part of the housing.

As a further improvement, the water intake handle includes a connecting member and a pressing member. One end of the connecting member is pivotally connected with the bracket, and the other end is connected with the pressing member. The first through hole is formed in the connecting member. The connecting member and the pressing member are in arc connection and are arranged at an angle.

As a further improvement, a pivot shaft is provided with an elastic member, so that the water intake handle automatically resets after the external force is cancelled.

Correspondingly, a refrigerator includes any one of the above refrigerator door bodies.

The present invention has the following beneficial effects: one end of the water intake handle in the water dispenser is rotatably connected onto the refrigerator door body by the pivot shaft, and only by pressing the other end of the water intake handle, the water outlet component can be driven to generate a displacement in the axial direction relative to the water inlet component. The structure is simple, the reliability is high, and thus the user experience is improved.

DETAILED DESCRIPTION

Figure 1:
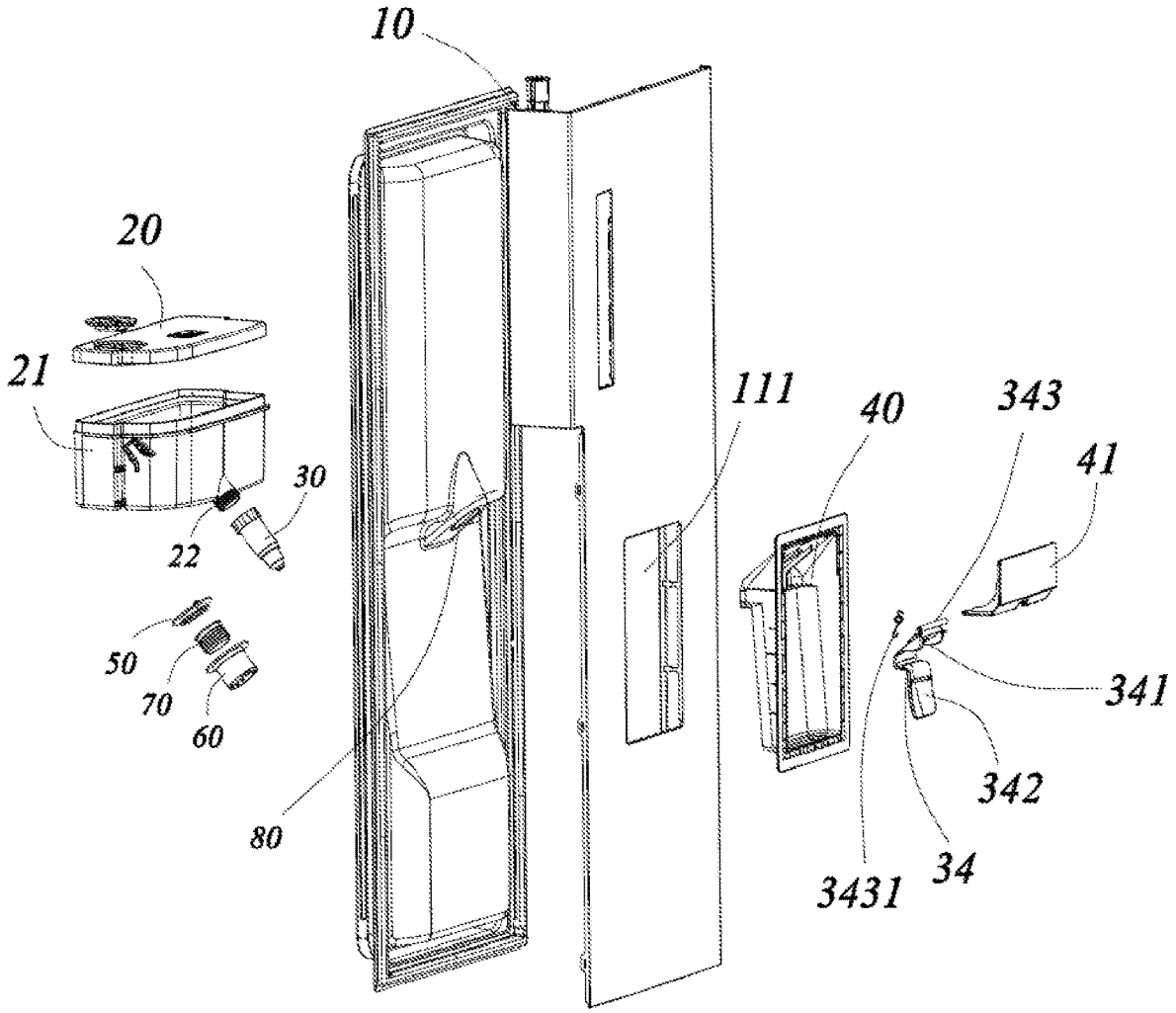
FIG. 1 is an exploded view of a refrigerator door body in one embodiment of the present invention.

The present invention will be described in detail below in conjunction with various embodiments shown in the accompanying drawings. However, the present invention is not limited by those embodiments, and changes in the structure, method, or function made by an ordinary person skilled in the art in accordance with these embodiments are included in the protection scope of the present invention.

The terms representing spatial relative positions, such as "upper", "above", "lower", and "below" as used herein describe the relationship of a unit or feature relative to another unit or feature in the accompanying drawings for the purpose of illustration. The terms of the spatial relative positions may be intended to include different orientations of the device in use or operation except the orientations shown in the drawings. For example, if the device in the drawings is turned over, the units described as "below" or "beneath" other units or features will be "above" other units or features. Thus, the exemplary term "below" can encompass two orientations of "above" and "below". The device may be otherwise oriented (rotated by 90 degrees or facing other directions) and spatially related descriptors used herein are explained accordingly.

Moreover, it should be understood that although the terms "first", "second" and the like may be used herein to describe various elements or structures, these described objects should not be limited by these terms. These terms are only used to distinguish these described objects from each other. For example, a first through hole may be referred to as a second through hole, and similarly a second through hole may also be referred to as a first through hole, which does not depart from the protection scope of the present application.

FIG. 1 shows a preferred embodiment of a refrigerator door body 10 in the present invention. The refrigerator door body 10 of the present invention is provided with a water dispenser and a water intake passage 80. The water intake passage 80 is communicated with the inside and outside of the refrigerator door body 10. The water dispenser includes a water storage tank 20 disposed at an inner side of the refrigerator door body 10 and a water intake assembly 30 at least partially disposed in the water intake passage 80. The outer side of the refrigerator door body 10 is recessed to form a receiving space 111. After passing through the water intake passage 80, the water intake assembly 30 is at least partially exposed in the receiving space 111, and the user can take water outside the refrigerator door without opening the refrigerator door, preventing the cold air in the refrigerator from leaking out.

The water storage tank 20 includes a tank 21. A water outlet 22 is formed in the lower part of the tank 21, and the water storage tank 20 is communicated with the water intake assembly 30 through the water outlet 22.

Figure 2:
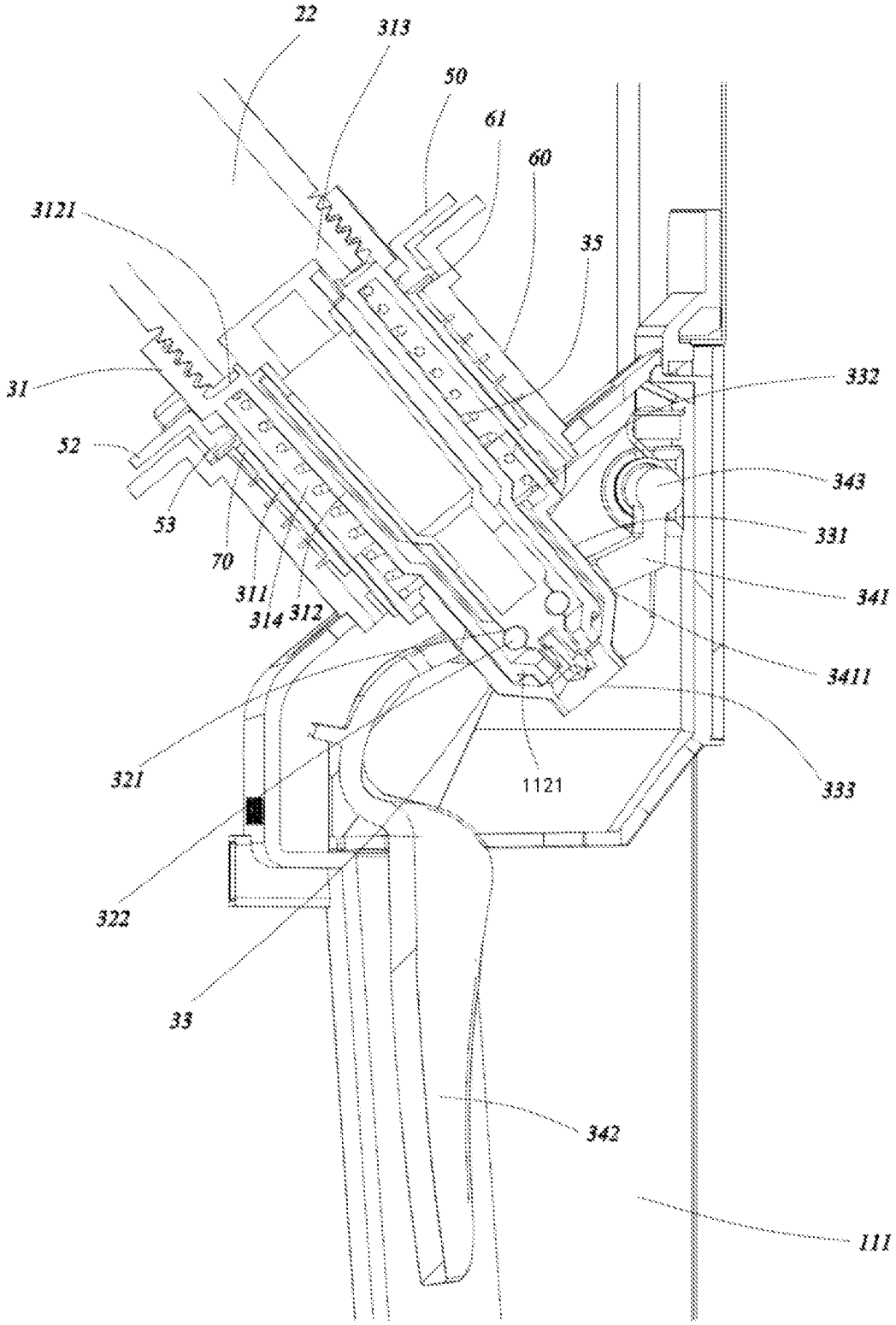
FIG. 2 is a structural diagram of a water intake assembly in an open status in one embodiment of the present invention.
Figure 3:
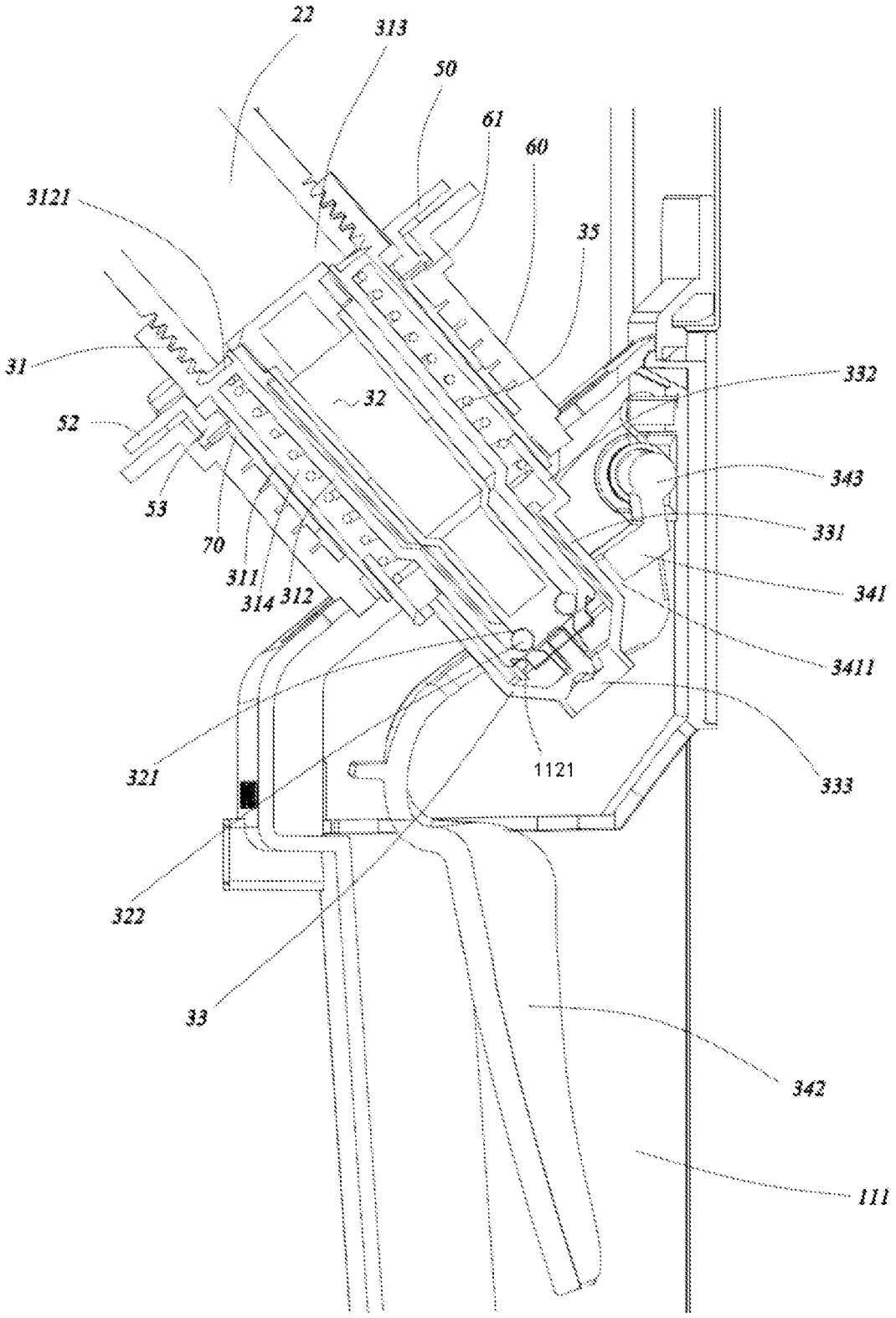
FIG. 3 is a structural diagram of the water intake assembly in a closed status in one embodiment of the present invention.

As shown in FIGS. 2 and 3, the water intake assembly 30 includes a water inlet component 31, a valve core 32, a water outlet component 33, and a water intake handle 34. The water intake handle 34 causes the water outlet component 33 to reciprocate along its axial direction relative to the water inlet component 31 under the action of an external force so that the water intake assembly 30 switches between an open status and a closed status.

The water inlet component 31 includes a water inlet component housing 311 and a first sealing wall 312 protruding from an inner wall of the water inlet component housing 311. One end of the water inlet component housing 311 is provided with a water inlet 313, and a stopper 1121 is arranged on an inner wall of one end of the first sealing wall 312 away from the water inlet 313 in a protruding manner. Specifically, the first sealing wall 312 is fixed to the inner wall of the water inlet component housing 311 through a convex plate 3121, and the water inlet component housing 311 and the convex plate 3121 collectively define the water inlet 313. Preferably, the inner wall of the water inlet 313 is provided with threads for threaded connection with the water outlet 22 of the water storage tank 20.

The valve core 32 is disposed in the water inlet component 31 in an inserting way. More specifically, the valve core 32 is disposed in the inner space formed by the first sealing wall 312 in an inserting way. A plurality of fin portions (not shown) is disposed on the outer wall of the valve core 32, and a water flow passage is formed between the adjacent fin portions. Preferably, the valve core 32 is hollowed out to reduce the water content of the water flow passage in the water inlet component 31. Meanwhile, the heat-insulating effect brought by the hollow structure of the valve core 32 contributes to the improvement in the condensation problem of the water intake assembly 30.

The water outlet component 33 includes a water outlet component housing 331 and a second sealing wall 332 protruding from one end of the water outlet component housing 331. A water outlet nozzle 333 is arranged at the end of the water outlet component housing 331 away from the second sealing wall 332.

After the water inlet component 31, the valve core 32, and the water outlet component 33 are assembled, the water inlet component housing 311 and the second sealing wall 332 are embedded with each other, and the water outlet component 33 and the valve core 32 are engaged with each other. The water outlet component 33 is at least partially exposed in the receiving space 11. Preferably, a housing 40 is disposed on four walls of the receiving space 11, and a bracket 41 is disposed at the upper part of the housing 40. A decorative panel can be adhered to the bracket 41, and the decorative panel can be printed with the font and pattern desired to be displayed, as needed.

Further, the outer diameter of the second sealing wall 332 is less than or equal to the inner diameter of the water inlet component housing 311. The first sealing wall 312 starts from the convex plate 3121. The length of the first sealing wall 312 is greater than the length of the water inlet component housing 311. The portion of the first sealing wall 312 protruding from the water inlet component housing 311 extends into the water outlet component housing 331. The stopper 1121 is arranged at one end of the first sealing wall 312 in a protruding manner, and is close to the water outlet nozzle 333.

Further, a first slot (not labeled) is disposed in one end of the valve core 32 close to the sealing member 322. A buckle (not labeled) is disposed on the water outlet component 33. The mutual engagement between the water outlet component 33 and the valve core 32 is realized by the mutual cooperation of the buckle and the first slot, so that the water outlet component 33 drives the valve core 32 to reciprocate along its axial direction.

Further, the valve core 32 is provided with a second slot 321. The sealing member 322 stucks in the second slot 321, and the first slot is closer to the water outlet nozzle 333 than the second slot 321. The first slot is designed below the second slot 321 and the sealing member 322, so that the water outlet nozzle 333 can be sealed by only one sealing ring, which reduces the hidden danger of the sealing and improves the reliability of the water intake assembly 30.

It is worth mentioning that a plurality of positioning portions (not shown) corresponding to the fin portions of the valve core 32 is arranged on the inner wall of the water outlet component housing 331. The mutual cooperation of the fin portion and the positioning portion causes the water outlet component 33 to be limited in the radial direction. The advantage of this design lies in that when the water outlet component 33 moves along its axial direction, it does not move in its radial direction and does not waggle horizontally.

In addition, a receiving space 314 is formed between the water inlet component housing 311 and the first sealing wall 312. An elastic member 35 is disposed in the receiving space 314. A portion of the second sealing wall 332 of the water outlet component 33 is also located in the receiving space 314. The elastic member 15 resets during the movement of the water outlet component 33 along its axial direction relative to the water inlet component 31 under the action of an external force.

The water intake handle 34 includes a connecting member 341 and a pressing member 342. One end of the connecting member 341 is pivotally connected to the bracket 41, and the other end and the pressing member 342 are in arc connection and disposed at an angle. The connecting member 341 is further provided with a first through hole 3411 for allowing the water intake assembly 30, specifically the water outlet component 33, to pass through. The inner diameter of the first through hole 3411 is greater than or equal to the outer diameter of the water outlet component housing 331.

When the water intake assembly 30 is in a closed status, the sealing member 322 abuts against the stopper 1121, and there is no acting force between the water outlet component housing 331 and hole walls of the first through hole 3411 in the water intake handle 34. When the water is taken, the pressing member 342 of the water intake handle 34 is pressed to drive one end of the connecting member 341 pivotally connected to the bracket 41 to rotate. The water intake handle 34 having the first through hole 3411 applies an acting force to the water outlet component housing 331, and the water outlet component 33 generates a displacement in an axial direction relative to the water inlet component 31. Thus, a gap is generated between the sealing member 322 and the stopper 1121, water flows out through the gap and the water outlet nozzle 333, and the water intake assembly 30 is in an open status.

When the water intake assembly 30 is in an open status, since the water outlet component 33 moves toward the water inlet component 31, the elastic member 35 is compressed. When water taking is completed, the external force applied to the pressing member 342 pressing the water intake handle 34 is cancelled, and the elastic member 35 is gradually restored to its initial status, thereby driving the water outlet component 33 and the valve core 32 to move in a direction away from the water tank 20 until the sealing member 322 on the valve core 32 abuts against the stopper 1121, the gap between the sealing member 322 and the stopper 1121 disappears, and the water flow is blocked. In the present invention, the sealing member 322 is disposed as close as possible to the water outlet nozzle 333 to achieve the purpose that only a minimum amount of water remains in the water outlet nozzle 333 below the sealing member 322. A small amount of water can be adsorbed in the water outlet nozzle 333 by means of surface tension without dripping out and thus the user experience is improved.

Preferably, a pivot shaft 343 is provided with an elastic member 3431. After the external force applied to the pressing member 342 of the water intake handle 34 is cancelled, the water intake handle 34 automatically resets, so that there is no acting force between the water outlet component housing 331 and the first through hole 3411 in the water intake handle 34.

Figure 4:
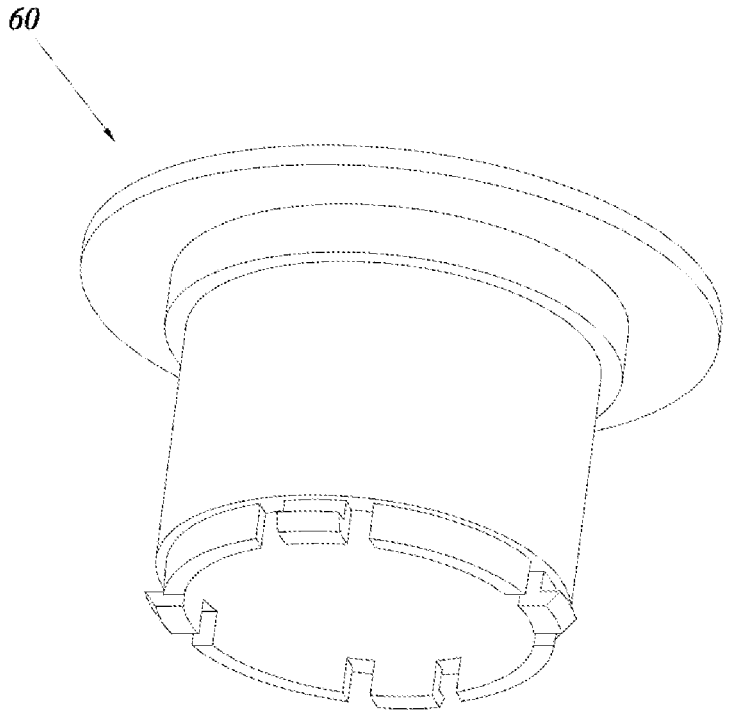
FIG. 4 is a structural diagram of a sleeve in one embodiment of the present invention.
Figure 5:
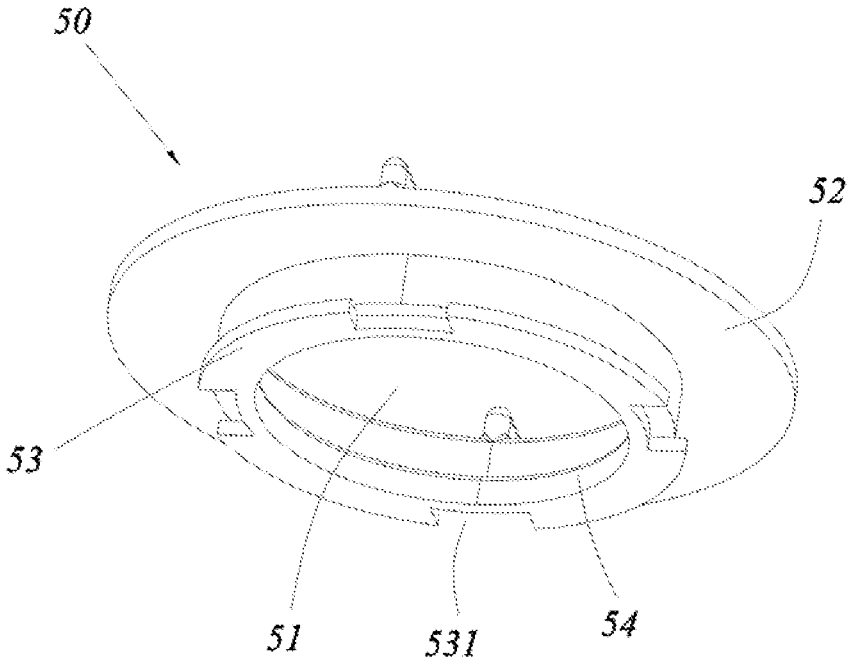
FIG. 5 is a schematic diagram of a pressing cap in one embodiment of the present invention.
Figure 6:
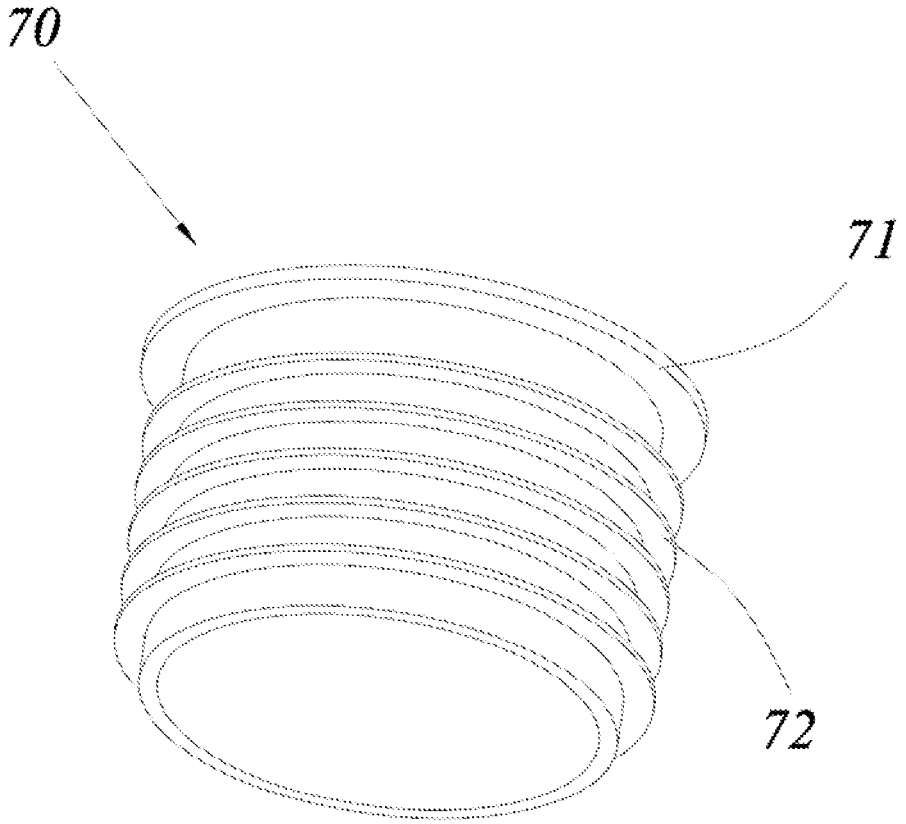
FIG. 6 is a structural diagram of a sealing ring in one embodiment of the present invention.

In combination with FIGS. 4-6, the inner wall of the water intake passage 80 is provided with a sleeve 60. A sealing ring 70 is disposed between the sleeve 60 and the water inlet component housing 311. The sleeve 60 is provided with a step portion 61 at the end close to the water storage tank 20. The upper end 71 of the sealing ring 70 is fixed to the step portion 61 by a pressing cap 50. A plurality of laps of fins 72 is arranged on the outer side of the sealing ring 70 so as to prevent the cold air inside the refrigerator from leaking out and meanwhile increase the friction between the sleeve 60 and the water inlet component housings 311.

The pressing cap 50 includes a second through hole 51 and an upper edge 52 and a lower edge 53 which extend outwards along the upper and lower ends of the second through hole 51 respectively.

Preferably, the width of the upper edge 52 is greater than the width of the lower edge 53. A positioning block (not shown) is disposed on the inner wall of the step portion 61. The lower edge 53 of the pressing cap 50 is provided with a positioning notch 531 adapted to the positioning block. When the pressing cap 50 is mounted on the sleeve 60, the positioning notch 531 only needs to correspond to the positioning block. The pressing cap 50 is mounted on the step portion 61 of the sleeve 60, and then only needs to be rotated, so that the positioning notch 531 and the positioning block are staggered, and the pressing cap 50 is not easily dropped from the sleeve 60.

In particular, a sealing protrusion 54 connected to the lower edge 53 is arranged on the inner wall of the second through hole 51 in a protruding manner. The sealing protrusion 54 covers a gap between the sleeve 60 and the water inlet component housing 311 to prevent leakage of cold air from the refrigerator.

Accordingly, the present invention further provides a refrigerator (not shown) which can obtain the advantageous effects of the refrigerator door body in the above embodiments by adopting the refrigerator door body described in each of the above embodiments. Other structures or functions of the refrigerator are not improved. Therefore, other structures of the refrigerator will not be repeated here.

It is apparent to those skilled in the art that the present invention is not limited to the details of the above exemplary embodiments, and the present invention can be embodied in other specific forms without departing from the spirit or essential characteristics of the present invention. Therefore, the present embodiments shall be considered as illustrative and not restrictive from any point, and the scope of the present invention is defined by the appended claims rather than the above illustration. Hence, all changes in the meaning and scope of equivalent elements of the claims are included in the present invention. Any reference signs in the claims should not be construed as limiting the claims.

In addition, it should be understood that although the description is described in terms of embodiments, not every embodiment merely includes one independent technical solution. The statement mode of the description is merely for the sake of clarity, and those skilled that should regard the description as a whole. The technical solutions in the respective embodiments may also be combined as appropriate to form other embodiments that can be understood by those skilled in the art.

What is claimed is:

1. A refrigerator door body provided with a water dispenser and a water intake passage, wherein the water dispenser comprising: a water storage tank disposed at an inner side of the refrigerator door body and a water intake assembly at least partially disposed in the water intake passage, and the water intake assembly comprises:

a water inlet component comprising a water inlet component housing and a first sealing wall protruding from an inner wall of the water inlet component housing, wherein a water inlet is formed in one end of the housing, a stopper is arranged on the inner wall of one end of the first sealing wall away from the water inlet in a protruding manner, and the water inlet is communicated with the water storage tank;

a water outlet component comprising a water outlet component housing and a second sealing wall protruding from one end of the water outlet component housing, wherein the second sealing wall and the water inlet component housing are embedded with each other, and a water outlet nozzle is arranged at the other end of the water outlet component housing;

a valve core disposed in the water inlet component in an inserting manner, wherein a sealing member sleeves the valve core, and the end of the valve core adjacent to the sealing member and the water outlet component are fixed to each other; and a water intake handle having one end of the water intake handle pivotally connected to the refrigerator door body and being provided with a first through hole for allowing the water outlet component to pass through;

wherein when the water intake assembly is in a closed status, the sealing member abuts against the stopper, and there is no acting force between the water outlet component housing and hole walls of the first through hole in the water intake handle;

the other end of the water intake handle is pressed, such that one end, pivotally connected to the refrigerator door body, of the water intake handle is rotated; the one end of the water intake handle having the first through hole applies an acting force to the water outlet component housing; the water outlet component is displaced axially relative to the water inlet component, and thus a gap is generated between the sealing member and the stopper, and the water intake assembly is in an open status;

a sleeve is provided in the inner wall of the water intake passage, a sealing ring is disposed between the sleeve and the water inlet component housing, the sleeve is provided with a step portion at the end close to the water storage tank, and the upper end of the sealing ring is fixed to the step portion by a pressing cap;

the pressing cap comprises a second through hole and an upper edge and a lower edge which extend outwards along the upper and lower ends of the second through hole respectively, and the width of the upper edge is greater than the width of the lower edge; and a sealing protrusion connected to the lower edge is arranged on an inner wall of the second through hole in a protruding manner.

2. The refrigerator door body according to claim 1, wherein the step portion is provided with a positioning block; the lower edge is provided with a positioning notch adapted to the positioning block; and the positioning notch corresponds to the positioning block, so that the pressing cap is mounted on the step portion of the sleeve.

3. The refrigerator door body according to claim 1, wherein the sealing protrusion covers a gap between the sleeve and the water inlet component housing.

4. The refrigerator door body according to claim 1, wherein the outer side of the refrigerator door body is recessed to form a receiving space; the water outlet component is at least partially exposed in the receiving space; a housing is arranged on the wall of the receiving space; and a bracket is arranged at the upper part of the housing.

5. The refrigerator door body according to claim 4, wherein the water intake handle comprises a connecting member and a pressing member; one end of the connecting member is pivotally connected with the bracket, and the other end is connected with the pressing member; the first through hole is arranged in the connecting member; and the connecting member and the pressing member are in arc connection and are arranged at an angle.

6. The refrigerator door body according to claim 5, wherein a pivot shaft is provided with an elastic member so that the water intake handle automatically resets after the external force is cancelled.

7. A refrigerator having a refrigerator door body, wherein the refrigerator door body is provided with a water dispenser and a water intake passage, the water dispenser comprises: a water storage tank disposed at the inner side of the refrigerator door body and a water intake assembly at least partially disposed in water intake passage, and the water intake assembly comprising:

a water inlet component comprises a water inlet component housing and a first sealing wall protruding from an inner wall of the water inlet component housing, wherein a water inlet is formed in one end of the housing, a stopper is arranged on an inner wall of one end of the first sealing wall away from the water inlet in a protruding manner, and the water inlet is communicated to the water storage tank;

a water outlet component comprises a water outlet component housing and a second sealing wall protruding from one end of the water outlet component housing, wherein the second sealing wall and the water inlet component housing are embedded with each other, and a water outlet nozzle is arranged at the other end of the water outlet component housing;

a valve core disposed in the water inlet component in an inserting manner, wherein a sealing member sleeves the valve core, and the end of the valve core adjacent to the sealing member and the water outlet component are fixed to each other; and a water intake handle having one end of the water intake handle pivotally connected to the refrigerator door body and being provided with a first through hole for allowing the water outlet component to pass through;

wherein when the water intake assembly is in a closed status, the sealing member abuts against the stopper, and there is no acting force between the water outlet component housing and hole walls of the first through hole in the water intake handle;

the other end of the water intake handle is pressed such that one end, pivotally connected to the refrigerator door body, of the water intake handle is rotated; the one end of the water intake handle having the first through hole applies an acting force to the water outlet component housing, and the water outlet component is displaced axially relative to the water inlet component such that a gap is generated between the sealing member and the stopper, and the water intake assembly is in an open status;

a sleeve is provided in an inner wall of the water intake passage, a sealing ring is disposed between the sleeve and the water inlet component housing, the sleeve is provided with a step portion at the end adjacent to the water storage tank, and an upper end of the sealing ring is fixed to the step portion by a pressing cap;

the pressing cap comprises a second through hole and an upper edge and a lower edge which extend outwards along upper and lower ends of the second through hole respectively, and the width of the upper edge is greater than the width of the lower edge; and a sealing protrusion connected to the lower edge is arranged on an inner wall of the second through hole in a protruding manner.

8. The refrigerator according to claim 7, wherein the step portion is provided with a positioning block, the lower edge is provided with a positioning notch adapted to the positioning block, and the positioning notch corresponds to the positioning block so that the pressing cap is mounted on the step portion of the sleeve.

9. The refrigerator according to claim 7, wherein the sealing protrusion covers a gap between the sleeve and the water inlet component housing.

* * * * *